US006228827B1

(12) United States Patent
Penninger et al.

(10) Patent No.: US 6,228,827 B1
(45) Date of Patent: May 8, 2001

(54) USE OF PROTEASE IN LIQUID TO GEL-FORM DETERGENTS

(75) Inventors: Josef Penninger, Hilden; Matthias Sunder, Duesseldorf; Theodor Voelkel, Erkrath; Beatrix Kottwitz, Duesseldorf, all of (DE); Werner Pichler, Kundl (AT)

(73) Assignee: Henkel Kommanditgesellschaft Auf Aktien, Duesseldorf (DE)

( * ) Notice: Subject to any disclaimer, the term of this patent is extended or adjusted under 35 U.S.C. 154(b) by 0 days.

(21) Appl. No.: 09/460,918

(22) Filed: Dec. 14, 1999

(30) Foreign Application Priority Data

Dec. 14, 1998 (DE) ..... 198 57 543

(51) Int. Cl.[7] ..... C11D 3/386; C11D 9/16

(52) U.S. Cl. ..... 510/320; 510/321; 510/392; 510/530; 510/336; 510/337; 510/345; 510/339; 510/473; 510/403

(58) Field of Search ..... 8/131; 510/320, 510/321, 392, 530, 336, 337, 345, 339, 473, 403

(56) References Cited

U.S. PATENT DOCUMENTS

| | | | | |
|---|---|---|---|---|
| 3,234,258 | | 2/1966 | Morris | 260/460 |
| 4,734,221 | * | 3/1988 | Edwards et al. | 252/544 |
| 5,075,041 | | 12/1991 | Lutz | 252/548 |
| 5,500,364 | * | 3/1996 | Christainson et al. | 435/221 |
| 5,573,701 | * | 11/1996 | Bulfari et al. | 510/397 |
| 5,801,039 | * | 9/1998 | Maurer et al. | 435/221 |
| 5,855,625 | * | 1/1999 | Maurer et al. | 8/137 |
| 5,985,639 | * | 11/1999 | Christianson et al. | 435/221 |

FOREIGN PATENT DOCUMENTS

| | | | |
|---|---|---|---|
| 44 00 024 | | 7/1995 | (DE) . |
| 0 164 514 | | 12/1985 | (EP) . |
| 1 156 513 | | 7/1956 | (FR) . |
| 839 407 | | 6/1960 | (GB) . |
| 873 214 | | 7/1961 | (GB) . |
| 58/17598 | | 12/1983 | (JP) . |
| WO90/13533 | | 11/1990 | (WO) . |
| WO91/08171 | | 6/1991 | (WO) . |
| WO95/07331 | | 3/1995 | (WO) . |
| 95/07331 | * | 3/1995 | (WO) . |
| 95/23221 | * | 3/1995 | (WO) . |
| WO95/23221 | | 8/1995 | (WO) . |

OTHER PUBLICATIONS

Derwent Patent Abstract (WPAT) No. 1990–336011 (45), Jan. 1, 2001.

Derwent Patent Abstract (WPAT) No. 1985–270605 (44), Jan. 1, 2001.

Derwent Patent Abstract (WPAT) No. 1991–172613 (24), Jan. 1, 2001.

Dewent Patent Abstract (WPAT) No. 1995–247054 (33), Jan. 1, 2001.

* cited by examiner

*Primary Examiner*—Yogendra Gupta
*Assistant Examiner*—Charles Boyer
(74) *Attorney, Agent, or Firm*—Wayne C. Jaeschke; Glenn E. J. Murphy

(57) ABSTRACT

The invention relates to the use of mutated protease of the subtilisin type which carries at least one mutation in its amino acid sequence, leading to a reduced positive charge or an increased negative charge in the substrate binding region of the molecule, in liquid to gel-form laundry detergents. This protease shows increased stability above all in detergents such as these.

16 Claims, No Drawings

USE OF PROTEASE IN LIQUID TO GEL-FORM DETERGENTS

This invention relates to the use of mutated protease of the subtilisin type, which carries at least one mutation in its amino acid sequence, leading to a reduced positive charge or an increased negative charge in the substrate binding region of the molecule, in liquid to gel-form laundry detergents and to a liquid to gel-form detergent.

Enzymes, especially proteases, are widely used in detergents, washing aids and cleaning compositions. They make a significant contribution to the removal of soils from the fabrics. In order to maintain their activity, the enzymes are generally used in combination with suitable enzyme stabilizers.

In liquid detergents in particular, enzymes are exposed to severe stressing through their intimate contact with other ingredients. Accordingly, the stability of enzymes is more critical in liquid detergents than it is in powder-form detergents.

In order to minimize the effort involved in protecting enzymes in detergents, there is a constant need for enzymes which show relatively high stability to typical detergent ingredients so that the content of stabilizers and the level of safety measures can be reduced or minimized.

Accordingly, the problem addressed by the present invention was to find enzymes, more particularly proteases, which would show adequate stability in liquid or gel-form detergents, even in the absence of or in the presence of only minimal quantities of suitable stabilizers.

It has surprisingly been found that a mutated protease of the subtilisin type shows high stability in liquid to gel-form detergents and that this stability can be improved even further by addition of diols and/or triols and optionally a boron compound.

Accordingly, the present invention relates to the use of mutated protease of the subtilisin type which carries at least one mutation in its amino acid sequence, leading to a reduced positive charge or an increased negative charge in the substrate binding region of the molecule, in liquid to gel-form laundry detergents.

The present invention also relates to liquid to gel-form detergents containing enzymes, surfactants and other typical ingredients, characterized in that the enzyme is mutated protease of the subtilisin type which carries at least one mutation in its amino acid sequence, leading to a reduced positive charge or an increased negative charge in the substrate binding region of the molecule.

A protease preferably used in accordance with the invention is described in International patent application WO 95/23221. Particularly high stability is exhibited by proteases derived from alkaline Bacillus lentus protease obtained from the DSM 5483 strain. A mutated alkaline protease M131(S3T+V4I+A188P+V193M+199I) or a mutated alkaline protease M130(S3T+A188P+V193M+V199I) is particularly preferred. Particularly good enzyme activity is obtained if the product from the fermentation process is used directly, i.e. without further working up, as the protease. The proteases used in accordance with the invention are commercially obtainable, for example under the names of BLAPS (manufacturer: Henkel KGaA, D üsseldorf) or Everlase® 24 LDP (manufacturer: Novo Nordisk). The protease used in accordance with the invention is preferably used in a quantity of 0.1 to 2.5% by weight, based on the final detergent.

An increase in the stability of the enzymes used in accordance with the invention can be achieved by using the enzymes in combination with one or more $C_{1-6}$ diols and/or $C_{1-6}$ triols and at least one boron compound. These additional components may each be used in a quantity of up to 5% by weight and, more particularly, up to 2% by weight, based on the final detergent. Examples of diols and triols are ethylene glycol, propylene glycol, butane diol, diglycol, propyl or butyl diglycol, hexylene glycol and glycerol. Examples of boron compounds which may be used in accordance with the present invention are boric acid, boron oxide, alkali metal borates, such as ammonium, sodium and potassium orthoborates, metaborates and pyroborates, borax in its various stages of hydration and polyborates such as, for example, alkali metal pentaborates. Organic boron compounds, such as esters of boric acid, may also be used.

The detergents according to the invention contain as further ingredients surfactants selected from anionic, nonionic, cationic and/or amphoteric surfactants which are normally present in a quantity of more than 15% by weight and, more particularly, above 20% by weight. Mixtures of anionic and nonionic surfactants are preferred from the applicational point of view. The total surfactant content of the detergents according to the invention is preferably above 20% by weight, based on the detergent as a whole.

Preferred nonionic surfactants are alkoxylated, advantageously ethoxylated, more particularly primary alcohols preferably containing 8 to 18 carbon atoms and an average of 1 to 12 moles of ethylene oxide (EO) per mole of alcohol, in which the alcohol residue may be linear or, preferably, 2-methyl-branched or may contain linear and methyl-branched residues in the form of the mixtures typically present in oxoalcohol residues. However, alcohol ethoxylates containing linear residues of alcohols of native origin with 12 to 18 carbon atoms, for example coconut oil fatty alcohol, palm oil fatty alcohol, tallow fatty alcohol or oleyl alcohol, and an average of 2 to 8 EO per mole of alcohol are particularly preferred. Preferred ethoxylated alcohols include, for example, $C_{12-14}$ alcohols containing 3 EO, 4 EO or 7 EO, $C_{9-11}$ alcohols containing 7 EO, $C_{13-15}$ alcohols containing 3 EO, 5 EO, 7 EO or 8 EO, $C_{12-18}$ alcohols containing 3 EO, 5 EO or 7 EO and mixtures thereof, such as mixtures of $C_{12-14}$ alcohol containing 3 EO and $C_{12-18}$ alcohol containing 7 EO. The degrees of ethoxylation mentioned are statistical mean values which, for a special product, may be either a whole number or a broken number. Preferred alcohol ethoxylates have a narrow homolog distribution (narrow range ethoxylates, NRE). In addition to these nonionic surfactants, fatty alcohols containing more than 12 EO may also be used. Examples of such fatty alcohols are tallow fatty alcohols containing 14 EO, 25 EO, 30 EO or 40 EO. Nonionic surfactants containing EO and PO groups together in the molecule may also be used in accordance with the invention. Block copolymers containing EO-PO block units or PO-EO block units and also EO-PO-EO copolymers and PO-EO-PO copolymers may be used. Mixed-alkoxylated nonionic surfactants in which EO and PO units are distributed statistically rather than in blocks may of course also be used. Products such as these can be obtained by the simultaneous action of ethylene and propylene oxide on fatty alcohols.

Other nonionic surfactants which may be used include alkyl glycosides with the general formula $RO(G)_x$ where R is a primary, linear or methyl-branched, more particularly 2-methyl-branched, aliphatic radical containing 8 to 22 and preferably 12 to 18 carbon atoms, G is a glycose unit containing 5 or 6 carbon atoms, preferably glucose. The degree of oligomerization x—which indicates the distribution of monoglycosides and oligoglycosides—is a number of 1 to 10 and preferably a number of 1.2 to 1.4.

Another class of preferred nonionic surfactants which are used either as sole nonionic surfactant or in combination with other nonionic surfactants are alkoxylated, preferably ethoxylated or ethoxylated and propoxylated, fatty acid alkyl esters preferably containing 1 to 4 carbon atoms in the alkyl chain, more particularly the fatty acid methyl esters which are described, for example, in Japanese patent application JP 58/217598 or which are preferably produced by the process described in International patent application WO-A-90/13533.

Nonionic surfactants of the amine oxide type, for example N-cocoalkyl-N,N-dimethylamine oxide and N-tallowalkyl-N,N-dihydroxyethyl amine oxide, and the fatty acid alkanolamide type are also suitable. The quantity in which these nonionic surfactants are used is preferably no more, in particular no more than half, the quantity of ethoxylated fatty alcohols used.

Other suitable surfactants are polyhydroxyfatty acid amides corresponding to formula (III):

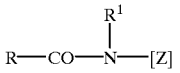

(III)

in which RCO is an aliphatic acyl radical containing 6 to 22 carbon atoms, $R^1$ is hydrogen, an alkyl or hydroxyalkyl radical containing 1 to 4 carbon atoms and [Z] is a linear or branched polyhydroxyalkyl radical containing 3 to 10 carbon atoms and 3 to 10 hydroxyl groups. The polyhydroxyfatty acid amides are known substances which may normally be obtained by reductive amination of a reducing sugar with ammonia, an alkylamine or an alkanolamine and subsequent acylation with a fatty acid, a fatty acid alkyl ester or a fatty acid chloride.

The group of polyhydroxyfatty acid amides also includes compounds corresponding to formula (IV):

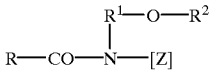

(IV)

in which R is a linear or branched alkyl or alkenyl group containing 7 to 12 carbon atoms, $R^1$ is a linear, branched or cyclic alkyl group or an aryl group containing 2 to 8 carbon atoms and $R^2$ is a linear, branched or cyclic alkyl group or an aryl group or an oxyalkyl group containing 1 to 8 carbon atoms, $C_{1-4}$ alkyl or phenyl groups being preferred, and [Z] is a linear polyhydroxy-alkyl group, of which the alkyl chain is substituted by at least two hydroxyl groups, or alkoxylated, preferably ethoxylated or propoxylated, derivatives of that group.

[Z] is preferably obtained by reductive amination of a sugar, for example glucose, fructose, maltose, lactose, galactose, mannose or xylose. The N-alkoxy- or N-aryloxy-substituted compounds may then be converted into the required polyhydroxyfatty acid amides by reaction with fatty acid methyl esters in the presence of an alkoxide as catalyst, for example in accordance with the teaching of International patent application WO-A-95/07331.

The content of nonionic surfactants in the detergents is preferably from 5 to 40% by weight, more preferably from 10 to 35% by weight and most preferably from 12 to 28% by weight, based on the detergent as a whole.

Suitable anionic surfactants are, for example, those of the sulfonate and sulfate type. Suitable surfactants of the sulfonate type are preferably $C_{9-13}$ alkyl benzenesulfonates, olefin sulfonates, i.e. mixtures of alkene and hydroxyalkane sulfonates, and the disulfonates obtained, for example, from $C_{12-18}$ monoolefins with an internal or terminal double bond by sulfonation with gaseous sulfur trioxide and subsequent alkaline or acidic hydrolysis of the sulfonation products. Other suitable surfactants of the sulfonate type are the alkane sulfonates obtained from $C_{12-18}$ alkanes, for example by sulfochlorination or sulfoxidation and subsequent hydrolysis or neutralization. The esters of a-sulfofatty acids (ester sulfonates), for example the α-sulfonated methyl esters of hydrogenated coconut oil, palm kernel oil or tallow fatty acids, are also suitable.

Preferred alk(en)yl sulfates are the alkali metal salts and, in particular, the sodium salts of the sulfuric acid semiesters of $C_{12-18}$ fatty alcohols, for example cocofatty alcohol, tallow fatty alcohol, lauryl, myristyl, cetyl or stearyl alcohol, or $C_{10-20}$ oxoalcohols and the corresponding semiesters of secondary alcohols with the same chain length. Other preferred alk(en)yl sulfates are those with the chain length mentioned which contain a synthetic, linear alkyl chain based on a petrochemical and which are similar in their degradation behavior to the corresponding compounds based on oleochemical raw materials. $C_{12-16}$ alkyl sulfates, $C_{12-15}$ alkyl sulfates and $C_{14-15}$ alkyl sulfates are preferred from the point of view of washing technology. Other suitable anionic surfactants are 2,3-alkyl sulfates which may be produced, for example, in accordance with U.S. Pat. No. 3,234,258 or U.S. Pat. No. 5,075,041 and which are commercially obtainable as products of the Shell Oil Company under the name of DAN®.

Other suitable anionic surfactants are sulfonated fatty acid glycerol esters. Fatty acid glycerol esters in the context of the present invention are the monoesters, diesters and triesters and mixtures thereof which are obtained where production is carried out by esterification of a monoglycerol with 1 to 3 moles of fatty acid or in the transesterification of triglycerides with 0.3 to 2 moles of glycerol. Preferred sulfonated fatty acid glycerol esters are the sulfonation products of saturated fatty acids containing 6 to 22 carbon atoms, for example caproic acid, caprylic acid, capric acid, myristic acid, lauric acid, palmitic acid, stearic acid or behenic acid.

The sulfuric acid monoesters of linear or branched $C_{7-21}$ alcohols ethoxylated with 1 to 6 moles of ethylene oxide, such as 2-methyl-branched $C_{9-11}$ alcohols containing on average 3.5 moles of ethylene oxide (EO) or $C_{12-18}$ fatty alcohols containing 1 to 4 EO, are also suitable. In view of their high foaming capacity, they are only used in relatively small quantities, for example in quantities of 1 to 5% by weight, in detergents.

Other suitable anionic surfactants are the salts of alkyl sulfosuccinic acid which are also known as sulfosuccinates or as sulfosuccinic acid esters and which represent monoesters and/or diesters of sulfosuccinic acid with alcohols, preferably fatty alcohols and, more particularly, ethoxylated fatty alcohols. Preferred sulfosuccinates contain $C_{8-18}$ fatty alcohol residues or mixtures thereof. Particularly preferred sulfosuccinates contain a fatty alcohol moiety derived from ethoxylated fatty alcohols which, considered in isolation, represent nonionic surfactants (for a description, see below). Of these sulfosuccinates, those of which the fatty alcohol moieties are derived from narrow-range ethoxylated fatty alcohols are particularly preferred. Alk(en)yl succinic acid preferably containing 8 to 18 carbon atoms in the alk(en)yl chain or salts thereof may also be used.

Other suitable anionic surfactants are, in particular, soaps. Suitable soaps are saturated and unsaturated fatty acid soaps, such as the salts of lauric acid, myristic acid, palmitic acid, stearic acid, hydrogenated erucic acid and behenic acid, and soap mixtures derived in particular from natural fatty acids, for example coconut oil, palm kernel oil or tallow fatty acids. The anionic surfactants, including the soaps, may be present in the form of their sodium, potassium or ammonium salts and as soluble salts of organic bases, such as mono-, di- or triethanolamine. The anionic surfactants are preferably present in the form of their sodium or potassium salts and, more preferably, in the form of their sodium salts.

The content of anionic surfactants in the detergents according to the invention is preferably from 5 to 30% by weight, more preferably from 10 to 25% by weight and most preferably from 15 to 25% by weight, based on the detergent as a whole.

One or more thickeners or thickening systems may be added to the detergent according to the invention to adjust its viscosity. The viscosity of the detergents according to the invention can be measured by standard methods (for example Brookfield RVD-VII viscosimeter at 20 r.p.m. and 20° C., spindle 3) and is preferably in the range from 500 to 5000 mPas. referred detergents have viscosities of 1000 to 4000 mPas, viscosities in he range from 2000 to 3500 mPas being particularly preferred.

Suitable thickeners are typically polymeric compounds. These dispersion, 25% in water; Stockhausen), SER-AD-FX-1100 (hydrophobic urethane polymer; Servo Delden), Shellflo® S (high molecular weight poly-saccharide, stabilized with formaldehyde; Shell) and Shellflo® XA (xanthan biopolymer, stabilized with formaldehyde; Shell).

Preferred water-based detergents contain 0.05 to 3% by weight, preferably 0.1 to 2% by weight and more preferably 0.2 to 1.0% by weight of a polysaccharide as thickener.

A polymeric thickener preferably used is xanthan, a microbial anionic heteropolysaccharide which is produced by Xanthomonas campestris and a few other species under aerobic conditions and which has a molecular weight of 2 to 15 million dalton. Xanthan consists of a chain with β-1,4-glucose (cellulose) with side chains. The structure of the sub-groups consists of glucose, mannose, glucuronic acid, acetate and pyruvate, the number of pyruvate units determining the viscosity of the xanthan.

Xanthan may be described by the following formula:

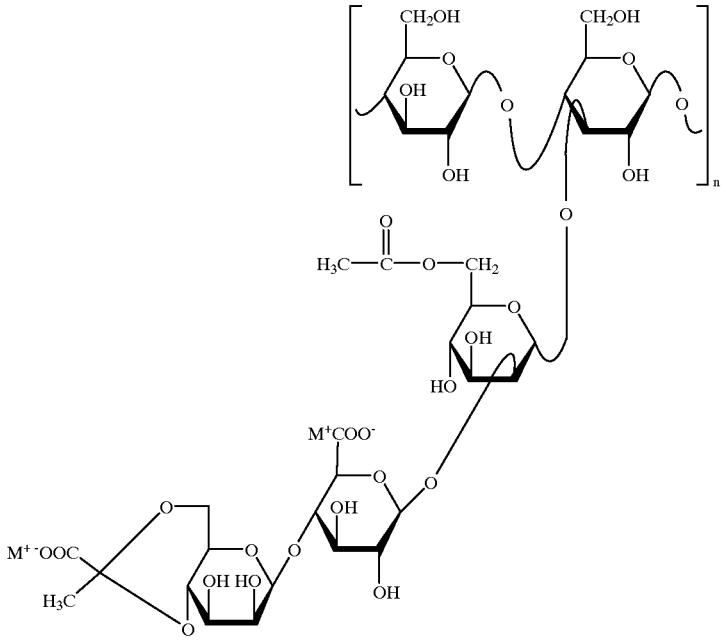

Basic unit of xanthan $M^+$ = Na,K,1/2 Ca organic high molecular weight compounds, which are also known as swelling agents and which take up liquids and swell in the process and, finally, change into viscose true or colloidal solutions, belong to the groups of natural polymers, modified natural polymers and fully synthetic polymers.

Naturally occurring polymers used as thickeners are, for example, agar agar, carrageen, tragacanth, gum arabic, alginates, pectins, polyoses, guar gum, locust bean gum, starch, dextrins, gelatin and casein.

Modified natural materials belong above all to the group of modified starches and celluloses, of which carboxymethyl cellulose and other cellulose ethers, hydroxyethyl cellulose and hydroxypropyl cellulose and also gum ethers are mentioned as examples.

A large group of thickeners which are widely used in various fields of application are the fully synthetic polymers, such as polyacrylic and poly-methacrylic compounds, vinyl polymers, polycarboxylic acids, polyethers, polyimines, polyamides and polyurethanes.

The thickeners may be present in a quantity of up to 5% by weight and preferably in a quantity of 0.05 to 3% by weight, based on the final detergent.

Thickeners from the classes of compounds mentioned are commercially obtainable and are marketed, for example, under the names of Acusol® 820 (methacrylic acid (stearyl alcohol-20 EO) ester/acrylic acid copolymer, 30% in water; Röhm & Haas), Dapral® GT 282 S (alkyl poly-glycol ether; Akzo), Deuterol® Polymer-11 (dicarboxylic acid copolymer; Schöner GmbH), Deuteron® XG (anionic heteropolysaccharide based on β-D-glucose, D-mannose, D-glucuronic acid; Schöner), Deuteron® XN (nonionic polysaccharide; Schöner GmbH), Dicrylan® Verdicker-O (ethylene oxide adduct, 50% in water/isopropanol; Pfersse Chemie), EMA® 81 and EMA® 91 (ethylene/maleic anhydride copolymer; Monsanto), Verdicker-QR-1001 (polyurethane emulsion, 19–21% in water/diglycol ether; Rohm & Haas), Mirox®-AM (anionic acrylic acid/acrylate copolymer Examples of other preferably used synthetic thickeners are polyurethanes and modified (meth)acrylates.

Polyurethanes (PUR) are produced by polyaddition from dihydric and higher alcohols and isocyanates and may be described by general formula I:

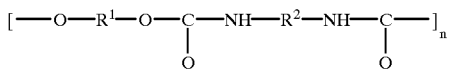

(I)

in which $R^1$ is a low molecular weight or polymeric diol residue, $R^2$ is an aliphatic or aromatic group and n is a natural number. $R^1$ is preferably a linear or branched $C_{2-12}$ alk(en)yl group, although it may also be a residue of a higher alcohol, so that crosslinked polyurethanes are formed which differ from general formula I above in the fact that other —O—CO—NH groups are attached to the substituent $R^1$.

Technically important PURs are produced from polyester and/or polyether diols and, for example, from 2,4- or 2,6-toluene diisocyanate (TDl, $R^2=C_6H_3—CH_3$), 4,4'-methylene di(phenyl isocyanate) (MDI, $R^2=C_6H_4—CH_2—C_6H_4$) or hexamethylene diisocyanate [HMDI, $R^2=(CH_2)_6$].

Commercially available polyurethane-based thickeners are marketed, for example, under the names of Acrysol®PM 12 V (mixture of 3–5% modified starch and 14–16% PUR resin in water; Rohm & Haas), Borchigel® L75-N (nonionic PUR dispersion, 50% in water; Borchers), Coatex® BR-100-P (PUR dispersion, 50% in water/butyl glycol; Dimed), Nopco® DSX-1514 (PUR dispersion, 40% in water/butyl triglycol; Henkel-Nopco), Verdicker QR 1001 (20% PUR emulsion in water/diglycol ether; Rohm & Haas) and Rilanit® VPW-3116 (PUR dispersion, 43% in water; Henkel).

Polyurethanes may be present in the detergents according to the invention in a quantity of 0.2 to 4% by weight, preferably in a quantity of 0.3 to 3% by weight and more preferably in a quantity of 0.5 to 1.5% by weight.

Modified polyacrylates which may be used in accordance with the present invention are derived, for example, from acrylic acid or methacrylic acid and may be described by general formula II:

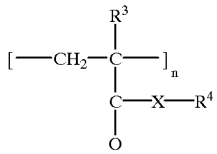

(II)

in which $R^3$ represents H or a branched or unbranched $C_{1-4}$ alk(en)yl group, X represents N—$R^5$ or O, $R^4$ is an optionally alkoxylated, branched or unbranched, optionally substituted $C_{8-22}$ alk(en)yl group, $R^5$ represents H or has the same meaning as $R^4$ and n is a natural number. Modified poly-acrylates such as these are generally esters or amides of acrylic acid or of an α-substituted acrylic acid. Of these polymers, those in which $R^3$ represents H or a methyl group are preferred. Among the polyacrylamides (X=N—$R^5$), both mono- ($R^5$=H) and di- ($R^5=R^4$)-N-substituted amide structures are possible, the two hydrocarbon radicals attached to the nitrogen atom being selected independently of one another from optionally alkoxylated branched or unbranched $C_{8-22}$ alk(en)yl radicals. Among the polyacrylates (X=0), those in which the alcohol was obtained from natural or synthetic fats or oils and is additionally alkoxylated, preferably ethoxylated, are preferred. Preferred degrees of alkoxylation are from 2 to 30, degrees of alkoxylation of 10 to 15 being particularly preferred.

Since the polymers suitable for use in accordance with the invention are technical compounds, the designation of the groups attached to X represents a statistical mean value which, in the individual case, can vary in regard to chain length or degree of alkoxylation. Formula II merely indicates formulae for idealized homopolymers. However, copolymers in which the percentage content of monomer units corresponding to formula II is at least 30% by weight may also be used in accordance with the present invention. For example, copolymers of modified polyacrylates and acrylic acid or salts thereof which also contain acidic H atoms or basic —$COO^-$ groups may also be used.

According to the invention, preferred modified polyacrylates are polyacrylate/polymethacrylate copolymers which correspond to formula IIa:

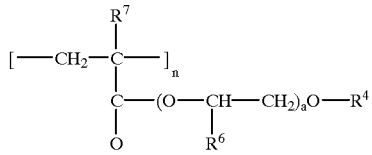

(IIa)

in which $R^4$ is a preferably unbranched, saturated or unsaturated $C_{8-22}$ alk(en)yl group, $R^6$ and $R^7$ independently of one another represent H or $CH_3$, the degree of polymerization n is a natural number and the degree of alkoxylation a is a natural number of 2 to 30 and preferably 10 to 20. $R^4$ is preferably a fatty alcohol moiety obtained from natural or synthetic sources, the fatty alcohol in turn preferably being ethoxylated ($R^6$=H).

Products corresponding to formula IIa are commercially obtainable, for example, under the name of Acusol® 820 (Rohm & Haas) in the form of 30% by weight dispersions in water. In the commercial product mentioned, $R^4$ is a stearyl group, $R^6$ is a hydrogen atom, $R^7$ is H or $CH_3$ and the degree of ethoxylation a is 20.

Modified polyacrylates corresponding to formula II may be present in the detergents according to the invention in a quantity of 0.2 to 4% by weight, preferably in a quantity of 0.3 to 3% by weight and more preferably in a quantity of 0.5 to 1.5% by weight, based on the detergent as a whole.

In addition, complexing agents may be used in combination with the thickeners mentioned above to stabilize viscosity. Examples of complexing agents are low molecular weight hydroxycarboxylic acids, such as citric acid, tartaric acid, malic acid or gluconic acid and salts thereof, citric acid and sodium citrate being particularly preferred. The complexing agents may be present in a quantity of 1 to 8% by weight, preferably 3.0 to 6.0% by weight and more preferably 4.0 to 5.0% by weight, based on the final detergent.

The detergents according to the invention may contain other ingredients which further improve their performance and/or aesthetic properties. According to the invention, preferred detergents may additionally contain one or more substances from the group of builders, bleaching agents, bleach activators, enzymes, electrolytes, solvents, pH regulators, perfumes, perfume carriers, fluorescers, dyes, hydrotropes, foam inhibitors, silicone oils, soil release compounds, optical brighteners, redeposition inhibitors, shrinkage inhibitors, anti-crease agents, dye transfer inhibitors, antimicrobial agents, germicides, fungicides, antioxidants, corrosion inhibitors, antistatic agents, ironing aids, waterproofing and impregnating agents, swelling and non-slip agents and UV absorbers.

Builders which may be present in the detergents according to the invention include, in particular, silicates, aluminium silicates (more particularly zeolites), carbonates, salts or organic di- and polycarboxylic acids and mixtures thereof.

Suitable crystalline layer-form sodium silicates correspond to the general formula $NaMSi_xO_{2x+1}\cdot H_2O$, where M is sodium or hydrogen, x is a number of 1.9 to 4 and y is a number of 0 to 20, preferred values for x being 2, 3 or 4. Crystalline layer silicates such as these are described, for example, in European patent application EP-A-0 164 514. Preferred crystalline layer silicates corresponding to the above formula are those in which M is sodium and x assumes the value 2 or 3. Both β- and δ-sodium disilicates $Na_2Si_2O_5\cdot y\ H_2O$ are particularly preferred, β-sodium disilicate being obtainable, for example, by the process described in International patent application WO-A-91/08171.

Other useful builders are amorphous sodium silicates with a modulus ($Na_2O:SiO_2$ ratio) of 1:2 to 1:3.3, preferably 1:2 to 1:2.8 and more preferably 1:2 to 1:2.6 which dissolve with delay and exhibit multiple wash cycle properties. The delay in dissolution in relation to conventional amorphous sodium silicates can have been obtained in various ways, for example by surface treatment, compounding, compacting or by overdrying. In the context of the invention, the term "amorphous" is also understood to encompass "X-ray amorphous". In other words, the silicates do not produce any of the sharp X-ray reflexes typical of crystalline substances in X-ray diffraction experiments, but at best one or more maxima of the scattered X-radiation which have a width of several degrees of the diffraction angle. However, particularly good builder properties may even be achieved where the silicate particles produce crooked or even sharp diffraction maxima in electron diffraction experiments. This may be interpreted to mean that the products have microcrystalline regions between 10 and a few hundred nm in size, values of up to at most 50 nm and, more particularly, up to at most 20 nm being preferred. So-called X-ray amorphous silicates such as these, which also dissolve with delay in relation to conventional waterglasses, are described for example in German patent application DE-A44 00 024. Compacted amorphous silicates, compounded amorphous silicates and overdried X-ray-amorphous silicates are particularly preferred.

The finely crystalline, synthetic zeolite containing bound water used in accordance with the invention is preferably zeolite A and/or zeolite P. Zeolite MAP® (Crosfield) is a particularly preferred P-type zeolite. However, zeolite X and mixtures of A, X and/or P are also suitable. According to the invention, it is also possible to use, for example, a commercially obtainable co-crystallizate of zeolite X and zeolite A (ca. 80% by weight zeolite X) which is marketed by CONDEA Augusta S.p.A. under the name of VEGOBOND AX® and which may be described by the following formula:

$$nNa_2O\cdot(1-n)K_2O\cdot Al_2O_3\cdot(2-2.5)SiO_2\cdot(3.5-5.5)H_2O.$$

The zeolite may be used as a spray-dried powder or even as an undried suspension still moist from its production. If the zeolite is used in the form of a suspension, the suspension may contain small additions of nonionic surfactants as stabilizers, for example 1 to 3% by weight, based on zeolite, of ethoxylated $C_{12-18}$ fatty alcohols containing 2 to 5 ethylene oxide groups, $C_{12-14}$ fatty alcohols containing 4 to 5 ethylene oxide groups or ethoxylated isotridecanols. Suitable zeolites have a mean particle size of less than 10 μm (volume distribution, as measured by the Coulter Counter Method) and contain preferably 18 to 22% by weight and more preferably 20 to 22% by weight of bound water.

The generally known phosphates may of course also be used as builders providing their use should not be avoided on ecological grounds. The sodium salts of the orthophosphates, the pyrophosphates and, in particular, the tripolyphosphates are particularly suitable.

Among the compounds yielding $H_2O_2$ in water which serve as bleaching agents, sodium perborate tetrahydrate and sodium perborate monohydrate are particularly important. Other useful bleaching agents are, for example, sodium percarbonate, peroxypyrophosphates, citrate perhydrates and $H_2O_2$-yielding peracidic salts or peracids, such as perbenzoates, peroxophthalates, diperazelaic acid, phthaloiminoperacid or diperdodecane dioic acid.

In order to obtain an improved bleaching effect where washing is carried out at temperatures of 60° C. or lower, bleach activators may be incorporated in the detergent tablets. The bleach activators may be compounds which form aliphatic peroxocarboxylic acids containing preferably 1 to 10 carbon atoms and more preferably 2 to 4 carbon atoms and/or optionally substituted perbenzoic acid under perhydrolysis conditions. Substances bearing O- and/or N-acyl groups with the number of carbon atoms mentioned and/or optionally substituted benzoyl groups are suitable. Preferred bleach activators are polyacylated alkylenediamines, more particularly tetraacetyl ethylenediamine (TAED), acylated triazine derivatives, more particularly 1,5-diacetyl-2,4-dioxohexahydro-1,3,5-triazine (DADHT), acylated glycolurils, more particularly tetraacetyl glycoluril (TAGU), N-acylimides, more particularly N-nonanoyl succinimide (NOSI), acylated phenol sulfonates, more particularly n-nonanoyl or isononanoyloxybenzenesulfonate (n- or iso-NOBS), carboxylic anhydrides, more particularly phthalic anhydride, acylated polyhydric alcohols, more particularly triacetin, ethylene glycol diacetate and 2,5-diacetoxy-2,5-dihydrofuran.

In addition to or instead of the conventional bleach activators mentioned above, so-called bleach catalysts may also be incorporated in the tablets. Bleach catalysts are bleach-boosting transition metal salts or transition metal complexes such as, for example, manganese-, iron-, cobalt-, ruthenium- or molybdenum-salen complexes or carbonyl complexes. Manganese, iron, cobalt, ruthenium, molybdenum, titanium, vanadium and copper complexes with nitrogen-containing tripod ligands and cobalt-, iron-, copper- and ruthenium-ammine complexes may also be used as bleach catalysts.

Besides the mutated proteases of the subtilisin type used in accordance with the invention, other enzymes enzymes from the class of hydrolases, such as proteases, esterases, lipases or lipolytic enzymes, amylases, cellulases or other glycosyl hydrolases and mixtures thereof may be used All these hydrolases contribute to the removal of stains, such as protein-containing, fat-containing or starch-containing stains, and discoloration in the washing process. Cellulases and other glycosyl hydrolases can contribute towards color retention and towards increasing fabric softness by removing pilling and microfibrils. Oxidoreductases may also be used for bleaching and for inhibiting dye transfer. Enzymes obtained from bacterial strains or fungi, such as Bacillus subtilis, Bacillus licheniformis, Streptomyces griseus and Humicola insolens are particularly suitable. Proteases of the subtilisin type are preferably used, proteases obtained from Bacillus lentus being particularly preferred. Of particular interest in this regard are enzyme mixtures, for example of protease and amylase or protease and lipase or lipolytic enzymes or protease and cellulase or of cellulase and lipase or lipolytic enzymes or of protease, amylase and lipase or lipolytic enzymes or protease, lipase or lipolytic enzymes and cellulase, but especially protease- and/or lipase-containing mixtures or mixtures with lipolytic enzymes. Examples of such lipolytic enzymes are the known cutinases. Peroxidases or oxidases have also been successfully used in some cases. Suitable amylases include in particular α-amylases, isoamylases, pullanases and pectinases. Preferred cellulases are cellobiohydrolases, endoglucanases and β-glucosidases, which are also known as cellobiases, and mixtures thereof. Since the various cellulase types differ in their CMCase and avicelase activities, the desired activities can be established by mixing the cellulases in the appropriate ratios.

Various salts may be used as electrolytes from the group of inorganic salts. Preferred cations are the alkali and alkaline earth metals; preferred anions are the halides and sulfates. From the production point of view, it is preferred to use NaCl or $MgCl_2$ in the detergents according to the invention. The percentage electrolyte content of the detergents according to the invention is normally 0.5 to 5% by weight.

Solvents which may be used in the detergents according to the invention belong, for example, to the group of monohydric or polyhydric alcohols, alkanolamines and glycol ethers providing they are miscible with water in the concentration range indicated. The solvents are preferably selected from ethanol, n- or i-propanol, butanols, ethylene glycol methyl ether, ethylene glycol ethyl ether, ethylene glycol propyl ether, ethylene glycol mono-n-butyl ether, diethylene glycol methyl ether, diethylene glycol ethyl ether, propylene glycol methyl, ethyl or propyl ether, dipropylene glycol monomethyl or monoethyl ether, diisopropylene glycol monomethyl or monoethyl ether, methoxy, ethoxy or butoxy triglycol, 1-butoxyethoxy-2-propanol, 3-methyl-3-methoxybutanol, propylene glycol-t-butyl ether and mixtures of these solvents. Solvents may be used in the liquid to gel-form detergents according to the invention in quantities of 0.5 to 15% by weight, preferably below 5% by weight and more preferably below 3% by weight.

In order to bring the pH value of the detergents according to the invention into the required range, it may be advisable to use pH regulators. Suitable pH regulators are any known acids and alkalis providing their use is not inappropriate for applicational or ecological reasons or on consumer protection grounds. The pH regulators are normally used in quantities of no more than 2% by weight of the total formulation.

In order to improve their aesthetic impression, the detergents according to the invention may be colored with suitable dyes. Preferred dyes, which are not difficult for the expert to choose, have high stability in storage, are not affected by the other ingredients of the detergents or by light and do not have any pronounced substantivity for textile fibers so as not to color them.

Foam inhibitors suitable for use in the detergents according to the invention are, for example, soaps, parafins and silicone oils.

Suitable soil-release compounds are, for example, nonionic cellulose ethers, such as methyl cellulose and methyl hydroxypropyl cellulose containing 15 to 30% by weight of methoxyl groups and 1 to 15% by weight of hydroxypropoxyl groups, based on the nonionic cellulose ether, and the polymers of phthalic acid and/or terephthalic acid known from the prior art or derivatives thereof, more particularly polymers of ethylene terephthalates and/or polyethylene glycol terephthalates or anionically and/or nonionically modified derivatives thereof. Of these, the sulfonated derivatives of phthalic acid and terephthalic acid polymers are particularly preferred.

Optical brighteners (so-called "whiteners") may be added to the detergents according to the invention to eliminate discoloration and yellowing of the treated laundry. These substances are absorbed onto the fibers and produce a brightening and fake bleaching effect by converting invisible ultraviolet radiation into visible longer-wave light, the ultraviolet radiation absorbed from the sunlight being reflected as a pale bluish fluorescence and giving pure white with the yellow of the discolored or yellowed laundry. Suitable compounds belong, for example, to the classes of 4,4'-diamino-2,2'-stilbene disulfonic acids (flavonic acids), 4,4'-distyryl biphenyls, methyl umbelliferones, coumarins, dihydroquinolines, 1,3-diaryl pyrazolines, naphthalic acid imides, benzoxazole, benzisoxazole and benzimidazole systems and the heterocycle-substituted pyrene derivatives. The optical brighteners are normally used in quantities of 0.05 to 0.3% by weight, based on the final detergent.

The function of redeposition inhibitors is to keep the soil detached from the fibers suspended in the wash liquor and thus to prevent the soil from being re-absorbed by the washing. Suitable redeposition inhibitors are water-soluble, generally organic colloids, for example glue, gelatine, salts of ether sulfonic acids of starch or cellulose or salts of acidic sulfuric acid esters of cellulose or starch. Water-soluble polyamides containing acidic groups are also suitable for this purpose. Soluble starch preparations and other starch products than those mentioned above, for example degraded starch, aldehyde starches, etc., may also be used. Polyvinyl pyrrolidone is also suitable. However, cellulose ethers, such as carboxymethyl cellulose (sodium salt), methyl cellulose, hydroxyalkyl cellulose, and mixed ethers, such as methyl hydroxyethyl cellulose, methyl hydroxypropyl cellulose, methyl carboxymethyl cellulose and mixtures thereof, in quantities of 0.1 to 5% by weight, based on the detergent, are preferably used.

Since flat textiles, particularly of rayon, rayon staple, cotton and blends thereof, can show a tendency to crease because the individual fibers are sensitive to sagging, folding, pressing and squeezing transversely of the fiber direction, the detergents according to the invention may contain synthetic anti-crease agents. These include, for example, synthetic products based on fatty acids, fatty acid esters, fatty acid amides, alkylol esters, alkylol amides or fatty alcohols mostly reacted with ethylene oxide or products based on lecithin or modified phosphoric acid esters.

For protection against microorganisms, the detergents according to the invention may contain antimicrobial agents.

Depending on the anti-microbial spectrum and the action mechanism, antimicrobial agents are classified as bacteriostatic agents and bactericides, fungistatic agents and fungicides, etc. Important representatives of these groups are, for example, benzalkanolium chlorides, alkylaryl sulfonates, halophenols and phenol mercuriacetate. However, the detergents according to the invention may also be completely free from these compounds.

In order to prevent unwanted changes to the detergents and/or the treated fabrics caused by the effect of oxygen and other oxidative processes, the detergents may contain antioxidants. This class of compounds includes, for example, substituted phenols, hydroquinones, pyrocatechols and aromatic amines and also organic sulfides, polysulfides, dithiocarbamates, phosphites and phosphonates.

Increasing wearing comfort can be obtained from the additional use of antistatic agents which may be additionally incorporated in the detergents according to the invention. Antistatic agents increase surface conductivity and thus provide for the improved dissipation of any charges developed. External antistatic agents are generally substances containing at least one hydrophilic molecule ligand and form a more or less hygroscopic film on the surface. These generally interfacially active antistatic agents may be divided into nitrogen-containing antistatics (amines, amides, quaternary ammonium compounds), phosphorus-containing antistatics (phosphoric acid esters) and sulfur-containing antistatics (alkyl sulfonates, alkyl sulfates). External antistatics are described, for example, in patent applications FR 1 156 513, GB 873,214 and GB 839.407. The lauryl (or stearyl) dimethyl benzylammonium chlorides disclosed therein are suitable as antistatics for textiles or as a detergent additive, a conditioning effect additionally being obtained.

In order to improve the water absorption capacity and the rewettability of the treated textiles and to make them easier to iron, silicone derivatives for example may be used in the detergents according to the invention. These silicone derivatives additionally improve the rinse-out behavior of the detergents according to the invention by virtue of their foam-inhibiting properties. Preferred silicone derivatives are, for example, polydialkyl and alkylaryl siloxanes where the alkyl groups contain 1 to 5 carbon atoms and are completely or partly fluorinated. Preferred silicones are polydimethyl siloxanes which may optionally be derivatized and are then aminofunctional or quatemized or bear Si—OH, Si—H and/or Si—Cl bonds. The preferred silicones have viscosities at 25° C. of 100 to 100,000 mPas and may be used in quantities of 0.2 to 5% by weight, based on the detergent as a whole.

Finally, the detergents according to the invention may also contain UV filters which are adsorbed onto the treated textiles and which improve the fastness of the fibers to light. Compounds which show these desirable properties are, for example, the compounds and derivatives of benzophenone with substituents in the 2- and/or 4-position which act through radiationless deactivation. Also suitable are substituted benzotriazoles, 3-phenyl-substituted acrylates (cinnamic acid derivatives), optionally with cyano groups in the 2-position, salicylates, organic Ni complexes and natural substances, such as umbelliferone and the body's own urocanic acid.

In order to avoid the composition of certain detergent ingredients catalyzed by heavy metals, heavy metal complexing agents may be used. Suitable heavy metal complexing agents are, for example, the alkali metal salts of ethylenediamine tetraacetic acid (EDTA) or nitrilotriacetic acid (NTA) and alkali metal salts of anionic polyelectrolytes, such as polymaleates and polysulfonates.

A preferred class of complexing agents are the phosphonates which are present in preferred detergents in quantities of 0.1 to 2.0% by weight, preferably 0.2 to 1.5% by weight and more preferably 0.3 to 1.0% by weight. These preferred compounds include in particular organo-phosphonates such as, for example, 1-hydroxyethane-1,1-diphosphonic acid (HEDP), aminotri(methylene phosphonic acid) (ATMP), diethylenetriamine penta(methylene phosphonic acid) (DTPMP or DETPMP) and 2-phosphonobutane-1,2,4-tricarboxylic acid (PBS-AM), which are mostly used in the form of their ammonium or alkali metal salts.

The detergents according to the invention are prepared simply by mixing the ingredients in stirred tanks, water, solvent and surfactant(s) preferably being introduced first and the other ingredients being subsequently added in portions. There is no need for separate heating during the production process. If heating is required, the temperature of the mixture should not exceed 80° C.

EXAMPLES

Detergents C, D, G and H according to the invention and comparison detergents A, B, E and F, of which the composition is shown in Table 1, were prepared by mixing the individual ingredients.

TABLE 1

| | Liquid detergents [% by weight] | | | | | | | |
|---|---|---|---|---|---|---|---|---|
| Ingredient | A | B | C | D | E | F | G | H |
| $C_{12-14}$ fatty alcohol · 7E0 | 10.0 | 10.0 | 10.0 | 10.0 | 25.0 | 25.0 | 25.0 | 25.0 |
| $C_{12-14}$ fatty alcohol sulfate, Na salt | 5.0 | 5.0 | 5.0 | 5.0 | 5.0 | 5.0 | 5.0 | 5.0 |
| $C_{12-18}$ fatty acid, Na salt | 8.0 | 8.0 | 8.0 | 8.0 | 9.0 | 9.0 | 9.0 | 9.0 |
| $C_{12-14}$ fatty acid, Na salt | 5.0 | 5.0 | 5.0 | 5.0 | 7.0 | 7.0 | 7.0 | 7.0 |
| $C_{12-14}$ alkyl polyglycoside | 2.0 | 2.0 | 2.0 | 2.0 | 2.0 | 2.0 | 2.0 | 2.0 |
| Propylene glycol | 1.0 | 1.0 | 1.0 | 1.0 | — | — | — | — |
| Glycerol | — | — | — | — | 1.0 | 1.0 | 1.0 | 1.0 |
| Ethanol | 1.0 | 1.0 | 1.0 | 1.0 | 1.0 | 1.0 | 1.0 | 1.0 |
| Boric acid | 1.6 | 1.0 | 1.0 | 1.0 | 1.0 | 1.0 | 1.0 | 1.0 |
| Polymer 1 | 0.5 | 0.5 | 0.5 | 0.5 | — | — | — | — |
| Polymer 22 | — | — | — | — | 0.5 | 0.5 | 0.5 | 0.5 |
| Savinase ® 16 LEX | 0.6 | — | — | | 0.6 | — | | |
| Alcalase ® 2,5 LDX | — | 0.6 | — | — | — | 0.6 | — | — |

TABLE 1-continued

| Ingredient | Liquid detergents [% by weight] A | B | C | D | E | F | G | H |
|---|---|---|---|---|---|---|---|---|
| BLAP ® 260 | — | — | 0.6 | — | — | — | 0.6 | — |
| Everlase ® 24 LDP | — | — | — | 0.6 | — | — | — | 0.6 |
| Water | | | | | to 100 | | | |

[1]Acusol ® 820 (Rohm & Haas)
[2]Keltrol ® (Monsanto)

To test their stability in storage, the liquid detergents were stored for 2, 4 and 8 weeks under various climatic conditions and the enzyme activity was measured (in %, based on the starting activity). The results of this evaluation are shown in Table 2 below.

TABLE 2

| Enzyme activity after storage at 20° C. and 30° C. | A | B | C | D | E | F | G | H |
|---|---|---|---|---|---|---|---|---|
| Storage at 20° C. | | | | | | | | |
| 2 Weeks | 65 | 83 | 99 | 96 | 77 | 76 | 98 | 97 |
| 4 Weeks | 44 | 68 | 98 | 94 | 66 | 70 | 96 | 95 |
| 8 Weeks | 32 | 58 | 95 | 92 | 59 | 62 | 95 | 92 |
| Storage at 30° C. | | | | | | | | |
| 2 Weeks | 39 | 55 | 94 | 92 | 52 | 49 | 87 | 88 |
| 4 Weeks | 19 | 38 | 73 | 77 | 42 | 39 | 86 | 82 |
| 8 Weeks | — | 18 | 71 | 70 | — | — | 84 | 78 |

It is clear from the test results that, even after 8 weeks' storage at 30° C., i.e. above room temperature, the detergents containing the enzymes according to the invention still show almost complete enzyme activity.

What is claimed is:

1. A method of laundering comprising the steps of forming a liquid or gel laundry detergent comprising 0.1% to 5% by weight of a thickener, a boron compound, one or more compounds selected from the group consisting of C1-6 diols and C1-6 triols, and a mutated subtilisin protease that carries at least one mutation in its amino acid sequence, said mutation leading to a reduced positive charge or to an increased negative charge in the substrate binding region of the enzyme, forming an aqueous laundering solution comprising said laundry detergent, and contacting a soiled textile in need of laundering with a cleaning-effective amount of the laundering solution to effect at least partial removal of the soil from the textile.

2. The method of claim 1, wherein the mutated subtilisin protease is derived from the DSM 5483 strain.

3. The method of claim 2, wherein the mutated subtilisin protease is a mutated alkaline protease M131 (S3T+V4I+A188P+V193M+V199I) or a mutated alkaline protease M130 (S3T+A188P+V193M+V 199I).

4. A liquid or gel-form laundry detergent comprising 0.1% to 2.5% by weight of an enzyme, 0.1% to 5% by weight of a thickener, a boron compound, one or more compounds selected from the group consisting of C1-6 diols and C1-6 triols, and a surfactant, wherein the enzyme is a mutated subtilisin protease that carries at least one mutation in its amino acid sequence, said mutation leading to a reduced positive charge or an increased negative charge in the substrate binding region of the enzyme.

5. The detergent of claim 4, comprising at least 20% by weight of the surfactant.

6. The detergent of claim 5, wherein the mutated subtilisin protease is derived from the DSM 5483 strain.

7. The detergent of claim 6, wherein the mutated protease is a mutated alkaline protease M131 (S3T+V4T+A188P+V193M+V199I) or a mutated alkaline protease M130 (S3T+A188P+V193M+V 199I).

8. The detergent of claim 5, wherein the C1-6 diols and C1-6 triols are selected from the group consisting of ethylene glycol, propylene glycol, and glycerol.

9. The detergent of claim 8, wherein the boron compound is selected from the group consisting of boric acid, boron oxide, alkali metal borates, borax, and polyborates.

10. The detergent of claim 9, wherein the boron compound is ammonium, sodium, or potassium ortho-, meta-, or pyroborate or an alkali metal pentaborate.

11. The detergent of claim 5, comprising 0.1% to 3% by weight of the thickener.

12. The detergent of claim 5, wherein the thickener is selected from the group consisting of agar, carrageen, tragacanth, gum arabic, alginates, pectins, polyoses, guar gum, locust bean gum, starch, dextrins, gelatin, casein, modified starches, celluloses, and synthetic polymers.

13. The detergent of claim 4, having a viscosity of 500 to 5000 mpas.

14. The detergent of claim 13, having a viscosity of 1000 to 4000 mPas.

15. The detergent of claim 14, having a viscosity of 2000 to 3500 mPas.

16. A liquid or gel form detergent having a viscosity of 500 to 5000 mPas, said detergent consisting essentially of at least 20% by weight of a surfactant, 0.1% to 5% by weight of a thickener, a boron compound, one or more compounds selected from the group consisting of C1-6 diols and C1-6 triols, and 0.1% to 2.5% by weight of a mutated subtilisin protease derived from the DSM 5483 strain, said mutated protease carrying at least one mutation in its amino acid sequence, said mutation leading to a reduced positive charge or an increased negative charge in the substrate binding region of the enzyme.

* * * * *